United States Patent [19]

Kinsman et al.

[11] Patent Number: 4,519,689

[45] Date of Patent: May 28, 1985

[54] METHOD AND APPARATUS FOR PROCESSING DISCRETE SHEETS OF FILM

[75] Inventors: Gordon F. Kinsman, Billerica; Ronald F. Lambert, Wayland; David A. Morrison, Framingham, all of Mass.

[73] Assignee: Polaroid Corporation, Cambridge, Mass.

[21] Appl. No.: 595,471

[22] Filed: Mar. 30, 1984

[51] Int. Cl.[3] ..... G03D 9/02

[52] U.S. Cl. ..... 354/304; 354/86; 354/318

[58] Field of Search ..... 354/84, 85, 86, 87, 354/88, 301, 303, 304, 318

[56] References Cited

U.S. PATENT DOCUMENTS

| | | | |
|---|---|---|---|
| 2,435,718 | 2/1948 | Land | 354/304 |
| 2,458,186 | 1/1949 | Messina et al. | 354/87 |
| 2,543,180 | 2/1951 | Land | 354/87 |
| 2,609,296 | 9/1952 | Land | 354/88 |
| 2,778,269 | 1/1957 | Bartlett | 354/86 |
| 3,003,871 | 10/1961 | Land et al. | 354/87 |
| 3,183,809 | 5/1965 | Nerwin | 354/304 |
| 3,396,650 | 8/1968 | Rubinstein et al. | 354/304 |
| 4,371,249 | 2/1983 | Czumak | 354/304 |

*Primary Examiner*—A. A. Mathews

*Attorney, Agent, or Firm*—David R. Thornton

[57] ABSTRACT

A method and apparatus for processing discrete rapid access of photographic film sheets exemplified by diffusion transfer film and film processing in which one or more sheets to be processed are supported on the working surface of one of two webs trained to pass through a processing gap defined by a pinch roller pair, for example. The discrete sheets are secured to either or both of the webs by adhesive means which may be releasable where the sheet being processed to be discharged as a product or permanent where the sheet or other component of the film system is to be retained for disposal with the web to which it is secured. The method and apparatus is applicable to single sheet film systems or to negative/positive film sheet systems wherein the image of an exposed negative is transferred to a positive sheet upon the application of processing fluid therebetween.

31 Claims, 7 Drawing Figures

METHOD AND APPARATUS FOR PROCESSING DISCRETE SHEETS OF FILM

BACKGROUND OF THE INVENTION

This invention relates to photographic film processing and more particularly, to a method and apparatus for rapid access processing of discrete components of photographic films.

The term "rapid access", as used herein and in the appended claims, is intended to delineate a type of photographic film or film processing which is capable of providing an image on a substrate which has been exposed directly to light defining the image or to which an image is transferred from another image or image facsimile bearing media, by application of a processing fluid layer over the area of the image to be provided. The most common form of rapid access film processing is the diffusion transfer process used in the field of instant photography, and in which a processing fluid is spread over the surface of a sheet or web carried exposed photosensitive emulsion so that the unexposed grains of silver halide in the emulsion layer are transferred to a positive image receiving layer or layer interface. The process has been used extensively for many years to provide positive photographic prints in which the transfer of unexposed grains from the emulsion layer on a negative sheet, for example, is to an image-receiving layer either on a separate positive sheet or incorporated in a photochemical system contained between coextensive opaque and transparent sheets. More recently, positive image transparencies have been developed in which both the photosensitive emulsion layer and the image-receiving layer are carried on a single transparent web or sheet so that upon processing, the transfer occurs between the emulsion layer and the image-receiving layer. Other types of films are known, however, where exposed and unexposed grains or dyes in an emulsion are processed to provide an image without transfer.

Where the rapid access film is initially provided as a strip or web packaged in roll form, such as in presently available slide film systems, processing of the exposed film is usually accomplished as an operation separate from the manipulative steps incidental to exposing and viewing the finished photographic product. Sheet-form films of the type presently used to render a positive photographic print, on the other hand, are processed as an incident to discharging the exposed film from a camera after exposure. To this end, the sheet-form films currently in use are in the nature of preassembled film units in which each unit contains a pod of processing fluid to be distributed completely over the area of photochemicals sandwiched between two sheets of the assembly as the exposed unit is passed to the pressure nip between a pressure roller pair or equivalent. The film units additionally incorporate such structural components as spacing rails between the two sheets to assure precision in the thickness of the processing fluid layer spread over the image receiving area as well as a fluid trap for receiving excess processing fluid supplied with each pod to assure complete coverage of the photochemicals carried over the area of the sheets.

The ultimate cost of each sheet-form photograph obtained using rapid access films and processing in current instant photographic equipment is attributable in substantial measure to the cost of assembling each film unit during manufacture. Such costs, together with either the measure of constraint on print format resulting from an integral assembly of the film unit components or the objections to waste disposal incident to peel-apart film units have compromised the advantages of rapid access photographic prints as against commercially processable conventional films. On the other hand, the photochemistry of rapid access films and film emulsions has progressed to a point where such factors as consistency of color rendition, image resolution and durability of the resulting photograph, both from the standpoint of resistance to physical handling and maintenance of image quality with aging, have enabled the attainment of photographs using rapid access films which are in many respects superior to photographs resulting from conventional laboratory developing procedures. In order for the many desirable attributes of sheet-form rapid access films to be appreciated at lower costs and with a broader range of accommodation to format, a need exists for improvements in the processing and handling of discrete components of a rapid access film systems without preassembly of such components.

SUMMARY OF THE INVENTION

In accordance with the present invention, a method and system of apparatus is provided by which discrete components of rapid access sheet films and chemicals may be handled for processing either as an adjunct to film exposure or as a separate processing operation independent of exposure. The invention is applicable both for simultaneous processing of negatives and prints or to the processing of negatives alone, and enables the use of pregapped pressure rollers by which the thickness of a processing fluid layer applied to the image area may be maintained within predetermined, precise tolerances.

In general, the invention is practiced by providing at least one carrier web to which components of a sheet-form rapid access film system to be dispensed as a product are secured releasably and to which components desirably retained for discard, such as spent processing fluid pods and the like, are permanently secured for disposal with the carrier web. Releasable securement of components to the carrier web is preferably effected by a high shear, low tear adhesive whereas permanent securement of components to the carrier web is achieved by an adhesive having high shear and high tear strength.

Processing fluid spread over the surface of a sheet-form film component is accomplished by passage of the carrier web, the film component and a cover web through the pregapped pressure rollers. The cover sheet is a relatively inexpensive paper stock capable of absorbing excess processing fluid without in any way adversely affecting the surface of the film sheet supported by the carrier. Both the carrier web and the cover sheet are sufficiently larger than the film sheet to be processed that no adverse effects are created by seepage of the processing fluid beyond the borders of the sheet being processed.

A principal object of the present invention is therefore, the provision of a method and system of apparatus by which processing of discrete components of sheet-form rapid access film is facilitated. Other objects and further scope of applicability of the present invention will become apparent from the detailed description to follow, taken in conjunction with the accompanying drawings in which like parts are designated by like reference numerals.

DETAILED DESCRIPTION OF THE PREFERRED EMBODIMENTS

Figure 1:
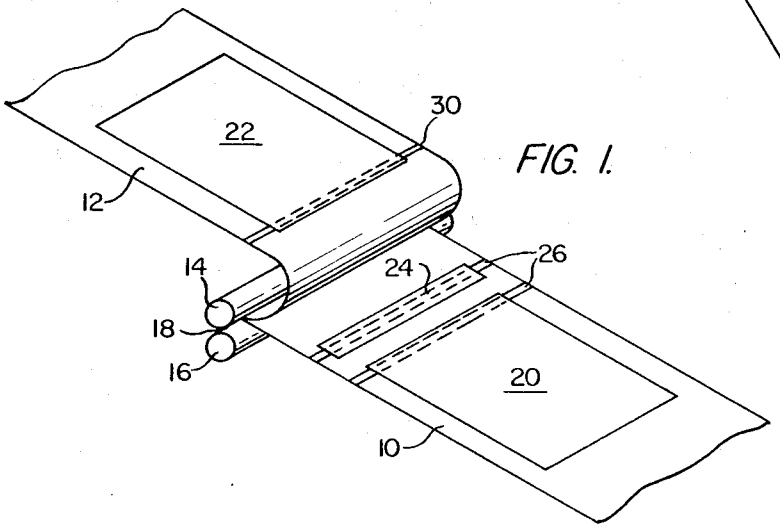
FIG. 1 is perspective view illustrating the apparatus of the present invention in its basic form.

In FIG. 1 of the drawings, the processing system of the present invention is represented very generally and schematically as including a first sheet or web 10, a second sheet or web 12 and a pair of pinch rollers 14 and 16 which cooperate to form a processing gap 18. Although the gap 18 is in the nature of a roller nip, the adjacent roller peripheries are spaced by a predetermined gap which, though adjustable to accommodate different thicknesses of materials, is the result of supporting the rollers 14 and 16 on preestablished and relatively fixed axes.

In the embodiment depicted in FIG. 1, an exposed negative sheet 20 is carried on a working surface of the first web 10 to register in overlying coextensive relationship with a positive sheet 22 carried on the working surface of the second web 12 as the two webs are passed between the gap 18 of the rollers 14 and 16. A rupturable pod 24 of processing fluid is carried also on the working surface of the first web 10 ahead of the negative 20 in the context of web feed direction through the roller gap 18. In light of the organization of components illustrated in FIG. 1, it will be appreciated that as the two webs 10 and 12 advance through the gap 18, the processing fluid pod 24 will be ruptured and the contents thereof spread over the area of the negative and positive sheets 20 and 22 to effect an image transfer from the negative sheet 20 to the positive sheet 22 in accordance with well known diffusion transfer film processing. It is to be noted, however, that unlike conventional diffusion transfer processing, the thickness of processing fluid spread between the coextensive and overlying negative and positive sheets 20 and 22 is a function solely of the dimensions of the gap 18 coupled with the thickness of the webs 10 and 12 and of the negative and positive sheets 20 and 22. Also it will be noted that since the width of the webs 10 and 12 exceeds the width of the negative and positive sheets 20 and 22, respectively, and further that since open areas of the webs 10 and 12 are provided fore and aft of the negative and positive sheets 20 and 22, any residual processing fluid which may escape off the side edges of the overlying sheets as they pass through the gap 18, or remaining after they pass through the gap will merely extend over onto the webs 10 and 12. In this respect, and as will be described in more detail below, at least one of the webs 10 or 12 is formed of absorbent material by which such residual processing fluid will be retained thereon.

Attachment of the sheets 20 and 22 to the respective webs 10 and 12 is designed so that portions or components of the overall film system to be discarded are retained on the web to which they are attached whereas those components to be retained as an end product are only releasably secured to one or the other of the respective webs. For example, in the embodiment depicted by FIG. 1, the negative sheet 20 and the processing fluid containing pod 24 are discarded after processing whereas the positive print sheet 22 is to be retained as the product of the processing operation. To this end, each of the webs is provided with transverse adhesive stripes, two of which are shown on the first web 10 and designated by the same reference numeral 26, whereas a third stripe 30 is provided on the second web 12 in the embodiment of FIG. 1. As will be described in more detail below, the adhesive stripes 26 on the first web 10 are intended to secure the pod 24 and the negative sheet 20 permanently to the web 10. The adhesive stripe 30 on the web 12 in this instance, however, releasably secures the positive sheet 22 to the second web 12 in a manner such that the sheet 22 will separate from the web 12 after processing has been completed.

The adhesive composition for the releasable adhesive stripe 30 on the second web 12 in FIG. 1 may be any of several commercially available pressure sensitive adhesives which exhibit a relatively high shear tack strength and relatively low tear or tensile strength. Water base acrylic adhesives of the type available from Rohm and Haas Co. of Philadelphia, Pa. under the designation LC-67 are exemplary of such pressure sensitive adhesives which function very well to retain the positive sheet 22 to the web 12, for example, but facilitate release after processing. Alternatively, the releasable adhesive stripe 30 may be heat responsive in the sense that it exhibits no tack strength under normal temperatures but which, when heated, becomes sufficiently tacky to retain the sheet 22 on the web 12. Where this latter type of adhesive is employed, an appropriate heating means (not shown) is incorporated in the processing system.

The adhesive composition for the permanent securement of components to either of the webs 10 or 12 is also commercially available and of a type known in the art as a "cohesive-adhesive". Such adhesives are commonly used in self-sealing envelopes and are characterized in that part of the adhesive structure is carried by one of the two components to be adhered whereas another part of the adhesive structure is carried by the other of the two parts to be secured. Although neither of the separate adhesive parts exhibits tack by itself, a very strong, high shear, high tear adhesive bond is formed when the two components are contacted with each other. Thus, in the example of FIG. 1, the adhesive stripes 26 carried by the web 10 are complemented by a similar adhesive stripe on the negative sheet 20 and processing fluid pod 24, respectively. In this way the sheet 20 and pod 24 will be permanently secured to the web 10.

In addition to securing components to the respective webs 10 and 12, both adhesive compositions serve an important sealing function at least with respect to the relationship of the leading edges of the sheets 20 and 22 and the webs 10 and 12, respectively. In particular, it will be noted that the pod 24 precedes the leading edges of the sheets 20 and 22 through the processing gap 18 so that the fluid contents thereof encounter a restriction in the form of the leading edge thickness of both sheets 20 and 22 before passing between the sheets. Because of the adhesive securement of the leading edges of both sheets to both webs and the sealing effect thereof, however, none of the processing fluid from the pod 24 can pass under the sheets or between the back surface thereof and the webs to which they are secured.

The functional characteristics of the webs 10 and 12 are likewise supplied by one or more of several commercially available sheet materials. Because the function of the web 10 in the embodiment depicted in FIG. 1 is merely as a carrier, the web can be of any of several plastic materials such as polyethylene, polystyrene or the like, but is preferred to be of a highly calendered paper such as "chart paper" available commercially under that designation from Regal Paper Company, for example. The web 12 which, though functioning as a carrier for the print sheet 22 in the embodiment of FIG. 1, also functions as a cover sheet or as a material for absorbing excess processing fluid. In this respect, the same "chart paper" used for the web 10 has demonstrated adequate utility in the processing system of the invention. Other materials which may be used for the cover web 12 are open-celled polystyrene webs subject only to these materials being available on an adequately low-cost basis. It is important that both of the web compositions be selected in relation to the adhesive components used for the stripes 26 and 30 that the webs may be rolled on themselves without adhering to the adhesive stripes.

Figure 2:
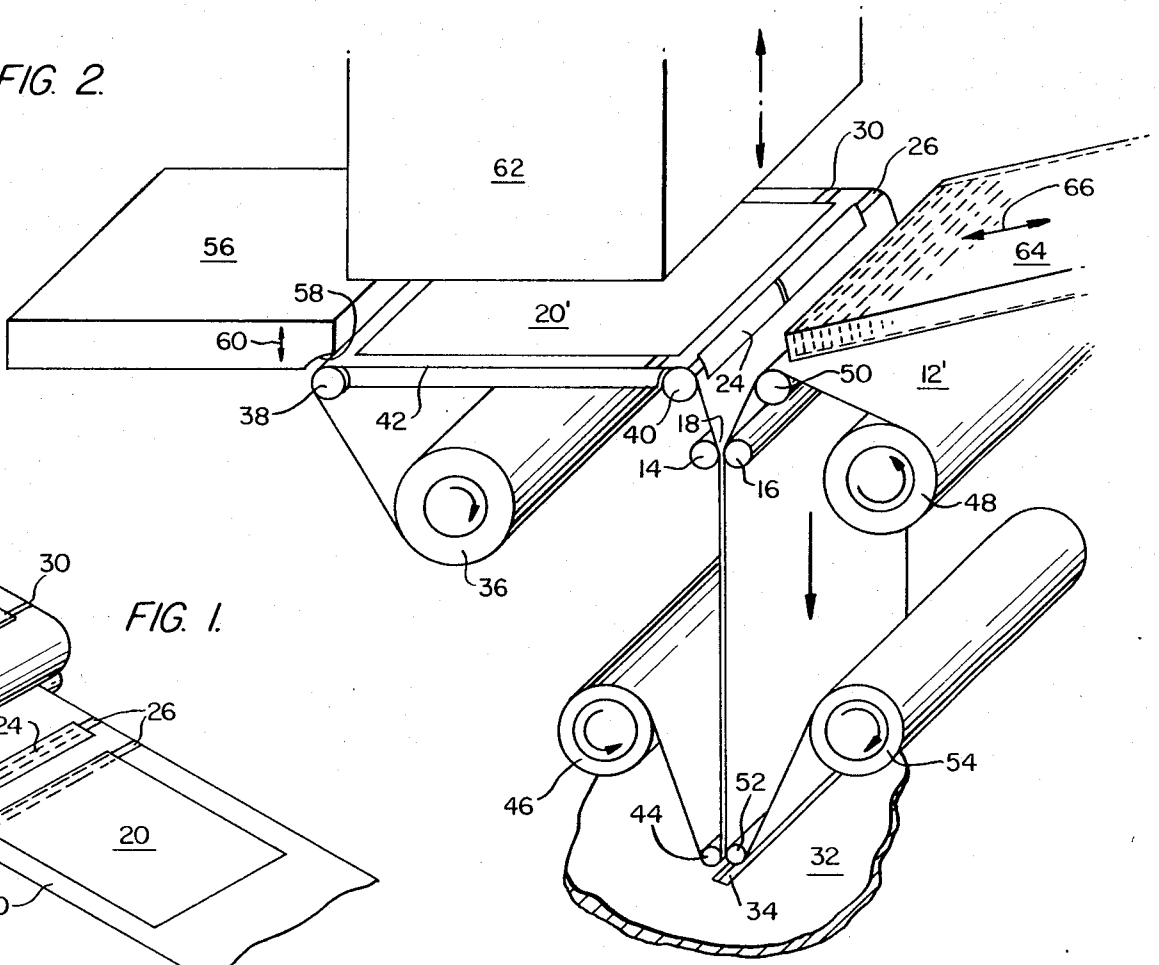
FIG. 2 is a perspective view illustrating schematically one embodiment of the invention.

In FIG. 2 of the drawings, the major working components of a photographic system embodying the present invention are illustrated schematically. Those components previously identified in FIG. 1 are designated by the same reference numerals whereas components differing in some way but similar in function are designated by the same reference numerals primed.

The system illustrated in FIG. 2 is adapted for the exposure and processing of a single negative sheet 20' and may be incorporated in an appropriate cabinet or housing which, though not illustrated in FIG. 2, is represented in part by a wall 32 having a discharge slot 34 through which the resultant photographic product is discharged. Although the wall 32 in this embodiment is depicted as a bottom wall or floor of the enclosure for the illustrated apparatus, the illustrated vertical orientation of operating components may be replaced by a horizontal orientation, in which case, the wall 32 would assume a vertical orientation as a side wall. In FIG. 2, the carrier web 10 is initially wound on a supply roll 36 and extends about idler rollers 38 and 40 to establish an exposure flight portion 42. After passing the idler roller 40, the web extends about the pinch roller 14, through the gap 18 of the pair of pinch rollers 14 and 16, downwardly about a relatively small diameter idler or peel roller 44 and upwardly to a takeup roll 46. As in the previous embodiment, the carrier web 10 of FIG. 2 supports on its working surface a cohesive adhesive stripe 26 and a releasable adhesive stripe 30 appropriately spaced along the length of the web 10 for successive application of processing fluid pods 24 and negative sheets 20' in a manner to be described in more detail below.

The second web 12' in the embodiment of FIG. 2 functions solely as a cover web and like the carrier web 10, is initially wound on a supply roll 48 to be trained about an idler roller 50, about the pinch roller 16, through the gap 18, downwardly in a superimposed coextensive relationship with the web 10 until passage about a lower idler roll 52 and then upwardly to a takeup roll 54.

In the system shown in FIG. 2, unexposed negative sheets 20' are initially supplied in a box-like container or cassette 56 having a discharge opening 58 through which the lower-most sheet 20 contained in the cassette 56 may be contacted with the carrier web 10 by movement of the cassette 56, or of at least the opening 58 thereof, by oscillation of the cassette 56 represented by the double-ended arrow 60. Thus, as the carrier web is fed from the supply roll 36 about the guide roller 38, as each releasable stripe 30 is presented to the opening 58, the cassette may be actuated to contact the leading edge of a negative sheet 20' with a releasable adhesive stripe 30 on the carrier web 10. As a result, the sheet 20 will be carried with the web along the exposure flight 42 thereof for presentation to an exposure device 62 which may in practice be a projector or equivalent.

The pods 24 in the embodiment of FIG. 2 are initially supplied in a magazine 64 supported by means (not shown) for movement in the direction of the double-ended arrow 66 in a manner to present successive pods to the permanent adhesive stripes 26 on the carrier web 10 in advance of the sheet 20' in the context of carrier web travel. Thus, and as described above with respect to FIG. 1, the pod 24 upon movement through the gap 18, is ruptured and spread over the area of the sheet 20' as previously described. Any residual processing fluid extending over the edges of the sheet 20' will be absorbed by the cover sheet 12' during passage of both webs 10 and 12' from the processing roller gap 18 until they separate by passage respectively about the lower guide rollers 44 and 52.

Because of the permanent nature of the cohesive-adhesive securement of the pod 24 to the carrier web 10, each such pod applied to the web 10 will be carried therewith and wound up on the takeup roll 46 for ultimate disposal with the spent web 10. Because of the releasable nature of the adhesive stripe 30, however, the leading edge of the processed negative sheet 20' will separate from the carrier 10 upon passage thereof about the relatively small radius of the peel roller 44 and discharge through the slot 34 of the cabinet wall 32.

Figure 3:
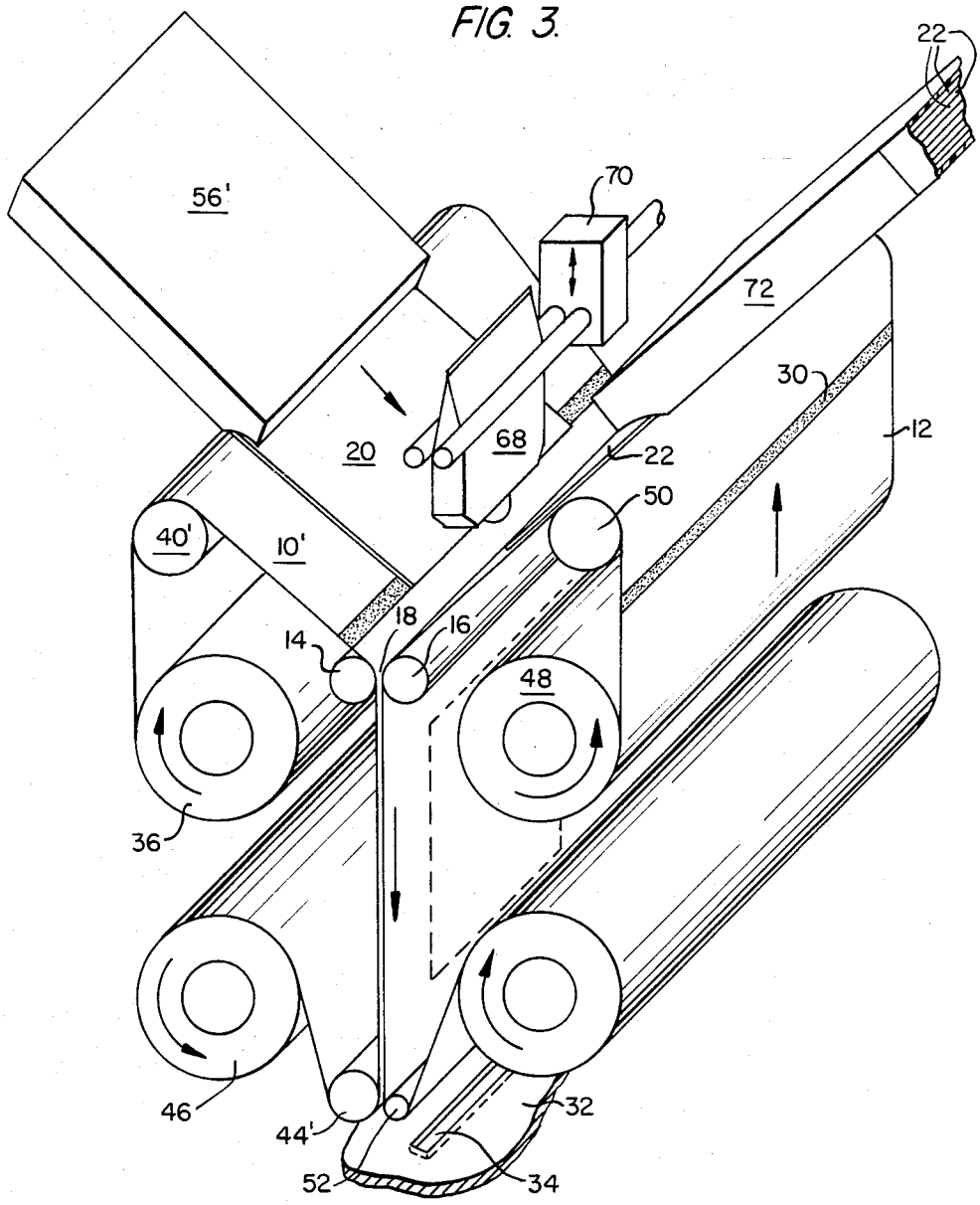
FIG. 3 is a similar perspective view illustrating the schematics of another embodiment of the invention.

In FIG. 3 of the drawings, an alternative system embodiment is illustrated in which parts identical to those previously described are designated by the same reference numerals whereas parts similar in structure and identical in function are represented by the same reference numerals primed. Also in the embodiment of FIG. 3, the apparatus illustrated is intended again to be included in an appropriate cabinet or housing, the bottom wall 32 and discharge slot 34 being the only parts illustrated. The arrangement shown in FIG. 3 is intended to process rapid access films in which a latent image carried on a previously exposed negative 20 is transferred to a positive sheet 22 as described above with reference to FIG. 1.

In the embodiment of FIG. 3, the first or carrier web 10', initially wound on a supply roll 36, is passed about an idler roller 40' and then through the gap 18 between the processing rollers 14 and 16, downwardly about a relatively large diameter idler roll 44' to the takeup roll 46. A series of cohesive-adhesive stripes 26 are provided on the web 10' in spaced intervals corresponding to the spacing of successive sheet-form film component being processed. The second web 12 in this embodiment, initially coiled on a supply roll 48, is trained about the idler roll 50, and the processing roller 16 to pass through the gap 18. The web 12 in this embodiment is trained about a relatively small diameter peel roller 52 and then back to the takeup roll 54. As in the embodiment of FIG. 1, the web 12 carries a series of longitudinally spaced transverse releasable adhesive stripes 30 on the working surface thereof or the surface presented in mutually facing relationship to the working surface on the web 10'.

In the embodiment of FIG. 3, an alternative form of processing fluid application is shown to include a collapsable container 68 supported above the gap 18 with an actuator 70 adapted to successively discharge a predetermined quantity of processing fluid from the container 68 to the gap 18. Exposed negative sheets are contained in a cassette 56' for presentation to the adhesive stripes 26 on the carrier web 10. The positive sheets 22 are similarly carried initially in a cassette 72 which for purposes of a clear understanding of the invention, may be identical to the cassette 56'.

Operation of the embodiment shown in FIG. 3 involves simultaneous application of the negative and positive sheets 20 and 22, respectively, to the webs 10' and 12 for passage with a quantity of processing fluid metered from the receptacle 68, through the gap 18 and then down in a common run to the bottom idler rolls 44' and 52. The manner of attachment of sheets from or to the webs 10' and 12 as well as the release or retention of the sheets to the webs, may be understood by reference to FIGS. 4 and 5 of the drawings.

Figure 4:
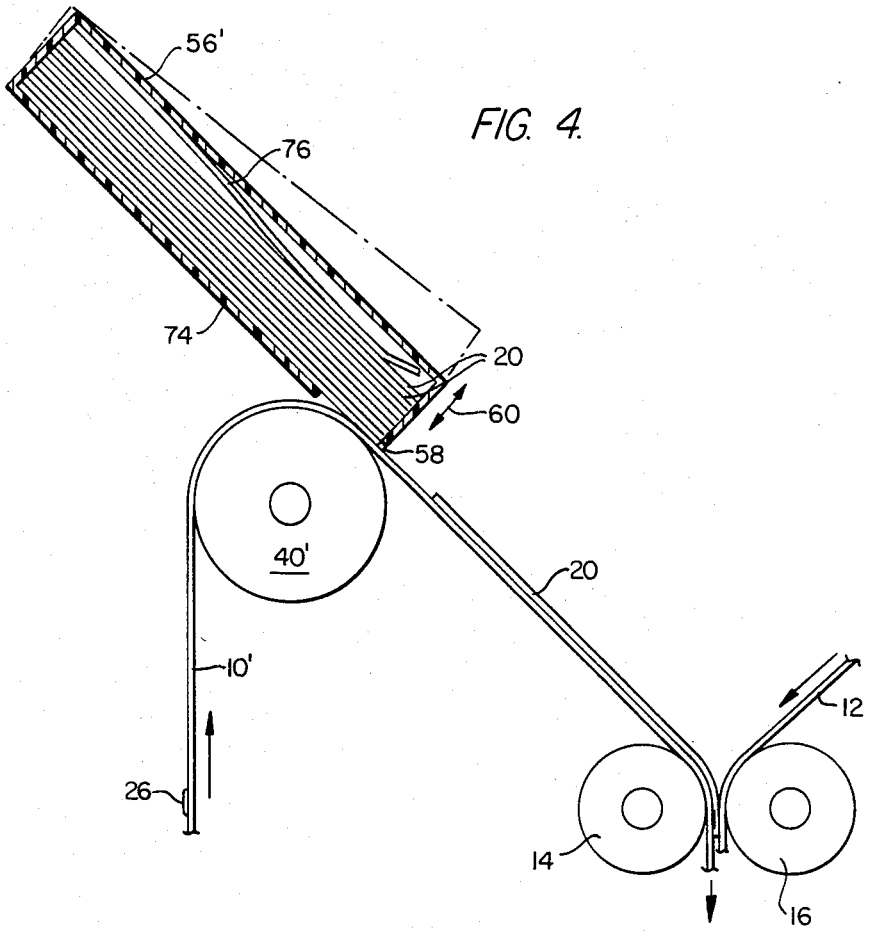
FIG. 4 is a fragmentary cross-section illustrating an arrangement for attachment of film sheets to a carrier web.
Figure 5:
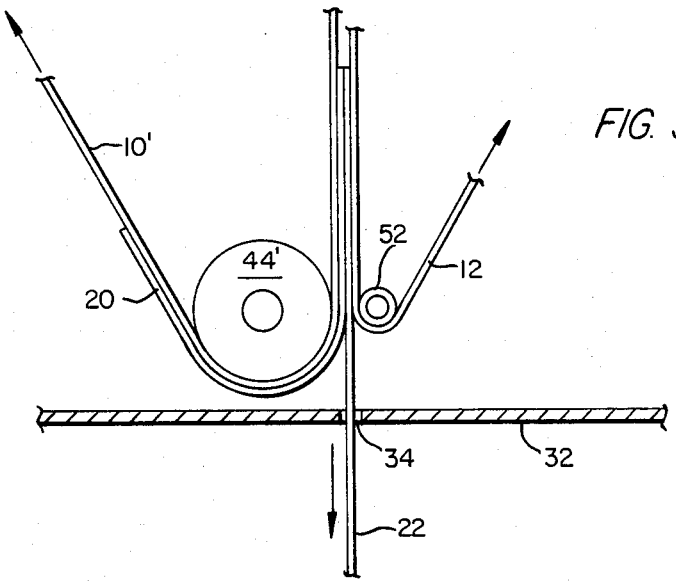
FIG. 5 is a fragmentary cross-section illustrating respective sheet retention and sheet delivery features of the invention.

In FIG. 4, the details of the cassette 56' are shown to enclose a plurality of the exposed negatives retained against a bottom wall 74 by a leaf spring 76, thus to ensure that the lower-most negative sheet 20 will be retained at the opening 58 in the lower and leading corner of the cassette 56'. As described above with respect to FIG. 2, the cassette is movable in an ocillatory fashion represented by the double-ended arrow 60 so that as the lower-most negative sheet 20 contacts the transverse cohesive-adhesive stripe 26 on the carrier web 10', the lower-most negative will be adhered to and drawn with the web 10' about the processing roller 14. Adherance of the positive sheets 22 in the embodiment of FIG. 3 to the web 12 is similar except that the adhesive stripes 30 thereon are releasable.

After passage through the processing gap 18, both the negative sheet and the positive sheet will be carried downwardly on the respective webs 10' and 12. As they reach the bottom rollers 44' and 52, the negative sheet 20 will be carried with the web 10' to the takeup spool 46. In this respect, the permanent securement of the negative sheet 20 to the web 10' by the cohesive-adhesive stripe 26 will be augmented by the relatively large diameter of the bottom idler roll 44'. Because of the relatively low tear strength of the adhesive stripe 30 on the web 12, however, the positive print 22, on passing the relatively small diameter peel roller 52, will break away from the web 12 and pass through the discharge slot 34 in the cabinet wall 32.

Figure 6:
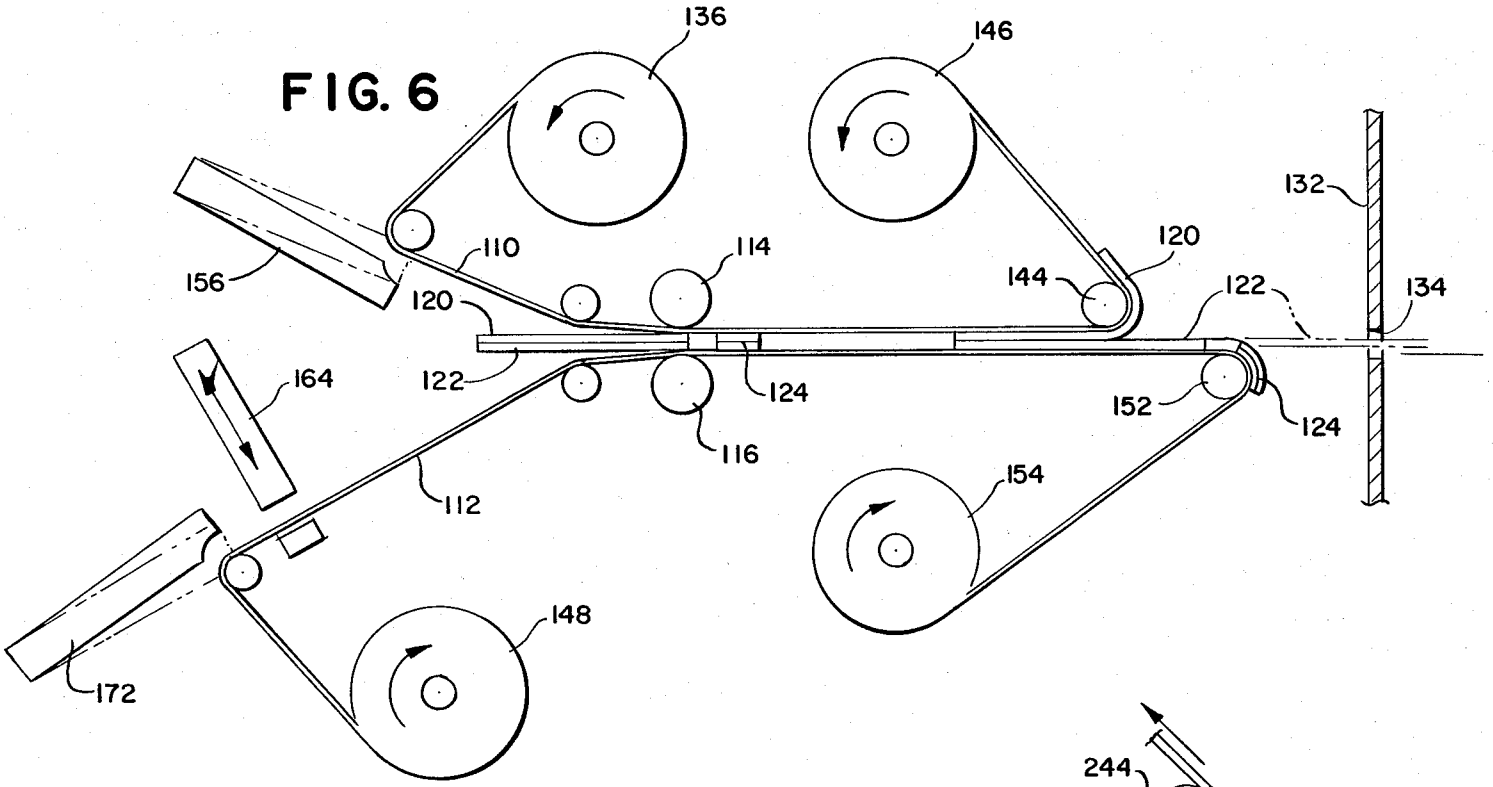
FIG. 6 is a largely schematic side elevation illustrating still another embodiment of the invention.

In FIG. 6 of the drawings a further embodiment of the invention is shown in which parts corresponding to parts previously identified are designated by the same reference numerals but in a "100" series. In the embodiment of FIG. 6, the processing path for photographic components, previously oriented vertically, is horizontally oriented. Thus, the product exit slot 134 is located in a side wall 132 of an enclosure for the processing apparatus shown schematically in FIG. 6.

The apparatus of FIG. 6 is similar to the embodiment of FIG. 3 in the sense that two photographic sheet components, that is, a negative sheet 120 and a positive sheet 122 are secured to and advanced by corresponding webs 110 and 112, respectively to a processing gap defined by a pair of rollers 114 and 116, preceded by a pod 124 of processing fluid. As in the previously described embodiments, the pods 124 are discharged from a magazine 164 whereas the negative and positive sheets 120 and 122 are discharged from filmpacks 156 and 172, respectively. Also, both the pods 124 and the negative sheets 120 are secured permanently to the webs 110 and 112, respectively, by cohesive adhesive while the positive sheets 122 are releasably secured to the web 112 by the aforementioned high shear, low tear adhesive.

The embodiment of FIG. 6 differs from previous embodiments in that the peel rollers 144 and 152 are offset in such a manner that the negative sheet 120 is separated from the positive sheet 122 prior to separation of the positive sheet from its carrier web 112 upon passage about the peel roller 152. This operation is achieved by offsetting the peel rollers 144 and 152 so that the web 110 encounters the peel roller 144 in advance of the web 112 encountering the peel roller 152. This arrangement has been found in practice to be desirable from the standpoint of providing a cleaner product in the positive sheet 122 than where separation of the positive sheet from the carrier web occurs simultaneously with separation of the negative sheet 120 from the positive sheet 122.

Figure 7:
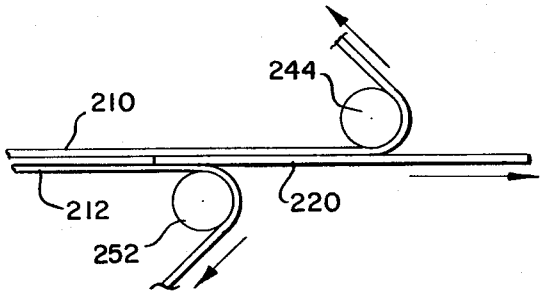
FIG. 7 is a fragmentary side elevation depicting a modification of the embodiment in FIG. 6.

The arrangement illustrated in FIG. 6 is particularly suited for use with two-sheet photographic systems. Where the processing operation is applied to a single sheet such as for the processing of a black and white negative by itself, the arrangement illustrated in FIG. 7 is preferred. In this instance, the single sheet product 220 is first removed from its carrier web 212 prior to separation of the cover web 210 from the side of the sheet 220 to which the processing fluid has been applied. Here again, the product sheet 220 is discharged more completely free of excess processing fluid than where the peel rollers 244 and 252 are encountered simultaneously by both webs 210 and 212.

Thus, it will be appreciated that as a result of the present invention, a highly effective method and apparatus is provided by which the principal objective and other advantageous results are obtained. Not only is the need for and thus the expense of preassembled film units completely avoided, but also the facility provided for the application of processing fluid to the rapid access film sheets offers a potential for enhanced rapid access photographs. The measure of control of processing fluid thickness over the entire image area as a result of the predetermined dimensions of the roller gap 18 is greater than that provided by internal guide rails of presently available preassembled film units. Moreover, the problems associated with excess processing fluid and disposal of unwanted components such as the processing fluid pod, are solved very simply and very effectively by the two webs 10 and 12, the inexpensive materials from which they are formed and the manner in which they are handled.

It will also be appreciated and is contemplated that modifications and/or changes may be made in the embodiments illustrated and described herein without departure from the invention. Accordingly, it is expressly intended that the foregoing description is illustrative only of preferred embodiments, not limiting, and that the true spirit and scope of the present invention be determined by reference to the appended claims.

What is claimed is:

1. The method for processing discrete sheets of rapid access type photographic films, said method comprising the steps of:

providing means to establish a processing gap;

feeding first and second webs through said gap so that a working surface on one of said webs is presented in mutually facing relationship to a working surface on the other of said webs;

releasably securing a rapid access film sheet to the working surface of at least one of said webs;

supplying a quantity of processing fluid to the working surfaces of said webs in advance of web passage through said gap and forwardly of the rapid access film sheet so that the processing fluid is spread uniformly over the area of said sheet as it passes with said webs through said gap; and removing said sheet from said one web after passage thereof through said gap.

2. The method recited in claim 1 wherein the width of said webs exceed the width of said sheet to assure that excess processing fluid spread beyond the edges of said sheet will be contained between the working surfaces of said webs.

3. The method recited in claim 1 wherein said sheet is adhesively secured to said one web across the leading edge of said sheet, thereby providing a seal to prevent passage of processing fluid between the leading edge of said sheet and the working surface of said one web.

4. The method recited in claim 3 wherein said sheet is adhesively secured to said one web by high-shear, low-tear, pressure sensitive adhesive.

5. The method recited in claim 4 wherein said adhesive is coated on the working surface of said one web as a transverse stripe.

6. The method recited in claim 1 wherein said processing fluid is supplied in a rupturable pod and including the step of permanently securing the pod to the working surface of one of said first and second webs.

7. The method recited in claim 6 wherein said sheet and said pod are secured to the working surface of said first web.

8. The method that is recited in claim 7 wherein at least said second web formed of material to absorb processing fluid in excess of that needed to cover said sheet.

9. The method recited in claim 1 including the steps of feeding said webs from respective supply rolls; winding said webs on separate takeup rolls after passing said gap; and releasably securing a plurality of said sheets to at least one of said webs for successive passage through said gap.

10. The method recited in claim 9 including the step of permanently securing to one of said webs a rupturable pod of processing fluid in advance of each of said sheets.

11. The method recited in claim 9 wherein the film sheets releasably secured to said one web are positive image receiving sheets and including the step of permanently securing negative sheets to the working surface of the other said webs for successive simultaneous passage of said negative and positive sheets through said gap in overlying coextensive relationship.

12. The method recited in claim 11 wherein said processing fluid is contained in a plurality of rupturable pods and including the steps of successively and permanently adhering said pods to said other web in advance of each of the sheets thereon.

13. The method recited in claim 11 wherein said processing fluid is contained in a receptacle adapted to meter a predetermined quantity of the processing fluid to the working surface of said webs as they enter said gap and including the step of dispensing from said container the metered quantity of said processing fluid for each of said successive sheets to be processed.

14. The method recited in claim 11 comprising the step of exposing said negative sheets after securement thereof to said other web.

15. The method recited in claim 11 comprising the step of feeding previously exposed negative sheets to the working surface of said other web.

16. The method recited in claim 1 wherein said removing step is carried out by training said one web about a small-radius bend with the working surface of said one web on the outside of said bend thereby to direct said web away from said sheet and release same from the working surface of said one web.

17. The method recited in claim 16 wherein said second web is separated from the surface of said sheet over which the processing fluid is spread by training said second web also about a small-radius bend, said release of said sheet from said first web and said separation of said sheet from said second web occurring at different intervals of time.

18. The method recited in claim 17 wherein the release of said sheet from said first web occurs in advance of separation of said sheet from said second web.

19. The method recited in claim 17 wherein said film sheet releasably secured to said one web is a positive image receiving sheet and including the step of permanently securing a negative sheet to the working surface of the said second web for simultaneous passage of said negative and positive sheets through said gap in overlying coextensive relationship and wherein said negative sheet is separated from said positive sheet in advance of release of said positive sheet from said first web.

20. Apparatus for processing rapid access film sheets comprising:

means defining a processing gap;

first and second webs trained through said gap, each of said webs having a working surface, said working surfaces being presented in mutually facing relationship at said gap;

releasable adhesive means carried on the working surface of at least one of said webs for securing a rapid access film sheet to said one web during passage thereof through said gap and for release of the sheet from said one web after passage of the sheet through said gap; and means for presenting a predetermined amount of processing fluid to the working surfaces of said webs in advance of said gap and forwardly of the film sheet releasably secured to said one web in the context of web and sheet movements through said gap.

21. The apparatus recited in claim 20 wherein said means defining said processing gap comprises a pair of pinch rollers rotatable on relatively fixed parallel axes spaced to provide said gap between the peripheries of said rollers.

22. The apparatus recited in claim 20 wherein said releasable adhesive means comprises at least one transverse stripe of high-shear, low-tear, pressure sensitive adhesive.

23. The apparatus recited in claim 20 wherein said means for presenting a predetermined amount of processing fluid comprises a processing fluid container and means for metering said predetermined amount of processing fluid from said container.

24. The apparatus recited in claim 20 wherein said means for presenting a predetermined amount of processing fluid comprises at least one rupturable pod of processing fluid and including means for permanently securing said pod to one of said webs.

25. The apparatus recited in claim 20 including first and second supply rolls and first and second take-up rolls for said first and second webs, respectively, said processing gap being located between said supply and takeup rolls.

26. The apparatus recited in claim 25 wherein at least said one web carries a plurality of transverse stripes of said releasable adhesive means, said stripes being spaced to accept successive rapid access film sheets on said one web.

27. The apparatus recited in claim 26 including film sheet retaining means and means for applying said film sheets from said retaining means successively to the releasable adhesive means on said one web.

28. The apparatus recited in claim 27 wherein said film sheet retaining means comprises a cassette having a bottom wall open at one end and means for applying at least the leading end of the film sheet lying against said bottom wall to the releasable adhesive means on said one web.

29. The apparatus recited in claim 20 including first and second peel rollers about which said first and second webs are trained, respectively, so that the working surface of said one web at said adhesive means is released from said sheet and so that the working surface of the other of said webs is separated from the surface of said sheet opposite from said adhesive means, said peel rollers being spaced from each other to be at different distances from said processing gap.

30. The apparatus recited in claim 29 wherein said first peel roller is closer to said processing gap than said second roller.

31. The apparatus recited in claim 29 wherein said film sheet releasably secured to said one web is a positive image receiving sheet and including permanent adhesive means for securing a negative sheet to the working surface of said other web for simultaneous passage of said negative and positive sheets through said processing gap in overlying coextensive relationship and wherein said first peel roller about which said one web is trained is spaced beyond said second peel roller from said processing gap so that said negative sheet is separated from said positive sheet prior to release of said positive sheet from said one web.

* * * * *